US007188503B2

(12) United States Patent
Zelin et al.

(10) Patent No.: US 7,188,503 B2
(45) Date of Patent: Mar. 13, 2007

(54) FINE WIRE DRAWING MACHINE

(75) Inventors: Michael Gregory Zelin, Canal Fulton, OH (US); Thomas Walter Starinshak, Wadsworth, OH (US); James Christopher Kish, Akron, OH (US)

(73) Assignee: The Goodyear Tire + Rubber Company, Akron, OH (US)

( * ) Notice: Subject to any disclaimer, the term of this patent is extended or adjusted under 35 U.S.C. 154(b) by 147 days.

(21) Appl. No.: 10/977,844

(22) Filed: Oct. 29, 2004

(65) Prior Publication Data

US 2006/0090532 A1 May 4, 2006

(51) Int. Cl.
*B21D 1/02* (2006.01)

(52) U.S. Cl. ..... 72/289

(58) Field of Classification Search ..... 72/280, 72/289, 282, 287

See application file for complete search history.

(56) References Cited

U.S. PATENT DOCUMENTS 1,518,714 A * 12/1924 Vaughn et al. ..... 72/279
1,693,224 A * 11/1928 Darmstadt et al. ..... 72/280
3,953,998 A 5/1976 Braun
3,955,393 A 5/1976 Moss et al.
3,979,940 A * 9/1976 Dutton et al. ..... 72/279
4,094,180 A 6/1978 Griffiths
4,099,403 A 7/1978 Alcock et al.
4,511,096 A 4/1985 DuFries
4,604,883 A 8/1986 Schaetzke et al.
5,189,897 A 3/1993 Lionetti et al.
5,247,823 A * 9/1993 Rossi ..... 72/279
5,535,612 A 7/1996 Vijayakar
6,164,112 A 12/2000 Frigerio
6,715,331 B1 4/2004 Zelin et al.

* cited by examiner

*Primary Examiner*—Daniel C. Crane
(74) *Attorney, Agent, or Firm*—Brouse McDowell; Roger D. Emerson; Timothy D. Bennett

(57) ABSTRACT

A wire drawing machine includes a frame; at least one die operatively supported by the frame; at least one drawing block rotatably supported by the frame for use in drawing wire through the die; and, a motor for use in providing power. A belt system connects the motor to the drawing block so that the drawing block can be rotated. To adjust the speed and torque of the drawing block, the belt is removed and one sprocket is replaced with a second sprocket.

6 Claims, 5 Drawing Sheets

FINE WIRE DRAWING MACHINE

I. BACKGROUND OF THE INVENTION

A. Field of Invention

This invention relates to methods and apparatuses for drawing wire and more specifically to methods and apparatuses for controlling the speed and torque of the drawing blocks used on a wire drawing machine.

B. Description of the Related Art

It is know to draw wire through multiple dies at multiple die positions of a wire drawing machine. The hardness of drawn steel wire results from the plastic deformation associated with the drawing process. The wire increases in hardness as it proceeds through the wire drawing machine. If the wire becomes too hard or brittle, breakage occurs during the drawing process or when the wire is subjected to torsion or bending.

As the wire is drawn through a die to reduce the cross sectional area, the outer fibers of the wire flow faster or at a higher velocity than those in its center. This flow velocity variation causes a lesser amount of elongation at the center of the wire than at the surface of the wire. A stress differential resulting from this mechanism of elongation induces compressive, longitudinal stresses on the surface of the wire and tensile, longitudinal stresses at its center. Voids, known as central bursts, can occur in the center of the wire when the tensile stresses exceed the breaking strength of the material. The central burst effect can be prevented by controlling the process geometries.

Strain introduced into the wire by the drawing process increases the tensile strength of the wire. Preferably, this increase is held constant at every die of the draft in a wire drawing machine. Analyses of the formation of central bursts show that bursting is more likely to occur if the increase in tensile strength remains low. Therefore, the wire is generally drawn through a draft of many dies each having a geometry to avoid the central burst zone.

Generally a drawing capstan or drawing block is used juxtaposed to each die in order to draw or pull the wire through the corresponding die. A well-known problem in the field of wire drawing machines is the problem of slip. Slip is the difference in the speed of the wire versus the tangential speed of the drawing block that the wire is traveling on. If slip is not properly controlled, both wire properties as well as the wire drawing machine can be damaged.

It is well-known to provide a drive system for use in rotating the drawing blocks of a wire drawing machine. Typically, one motor is used to drive multiple drawing blocks. Such a design generally works well for its intended purpose. The problem, however, with this type of drive system is that slip at each drawing block cannot be carefully controlled. One attempted solution to this problem is to provide one motor for each drawing block. In this way, the speed and torque at each drawing block can be carefully controlled thereby controlling slip. The problem with this solution, however, is the expense of providing all the required motors. It is well-known, for example, to use twenty (20) or more drawing blocks which would require twenty (20) or more motors.

What is needed is a method and device to accurately adjust the rotational condition of each drawing block without the need for multiple motors.

II. SUMMARY OF THE INVENTION

According to one aspect of this invention, a wire drawing machine comprises: (1) a frame; (2) at least a first die operatively supported by the frame; (3) at least a first drawing block rotatably supported by the frame for use in drawing wire through the first die; and, (4) a motor for use in providing power to rotate the first drawing block. Drive means is also provided and operatively connects the motor to the first drawing block. The drive means can be selectively adjusted to drive the first drawing block at a first rotational condition and can also be adjusted to selectively drive the first drawing block at a second rotational condition.

According to another aspect of this invention, a method of adjusting the rotational condition of a first drawing block on a wire drawing machine is provided. This method comprises the steps of: (1) providing a wire drawing machine as described above; (2) driving the first drawing block at a first rotational condition; (3) adjusting the drive means; and, (4) driving the fist drawing block at a second rotational condition.

One advantage of this invention is that the slip can be easily controlled at each drawing block.

Another advantage of this invention is that the slip can be controlled while using only a minimum number of motors.

Still another advantage of this invention is that the rotational condition, such as speed and torque, at each drawing block can be easily adjusted as required for the specific wire being drawn.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DESCRIPTION OF THE PREFERRED EMBODIMENT

Figure 1:
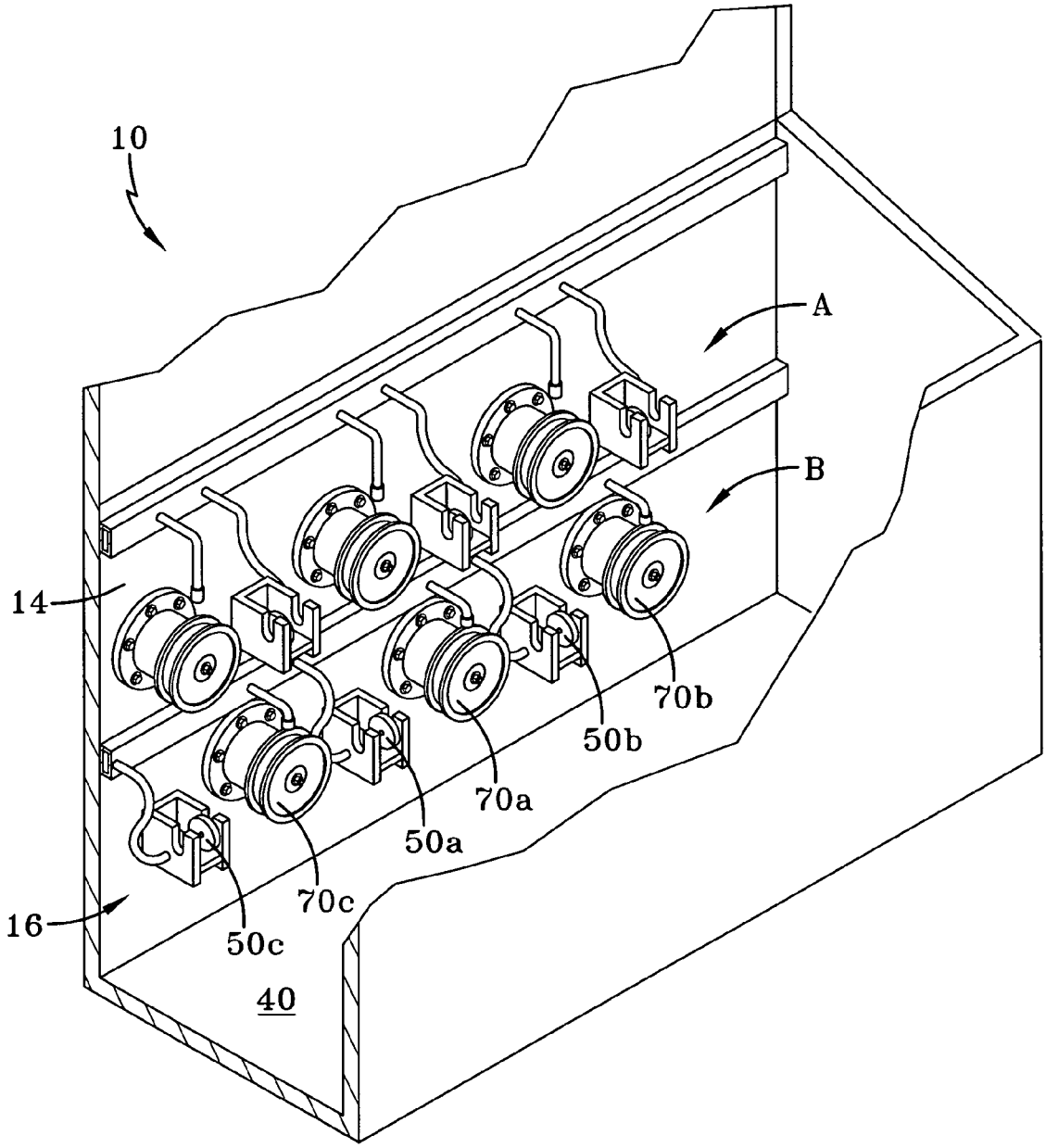
FIG. 1 is a perspective front view of a wire drawing machine according to this invention showing two banks of wire dies and drawing blocks.
Figure 2:
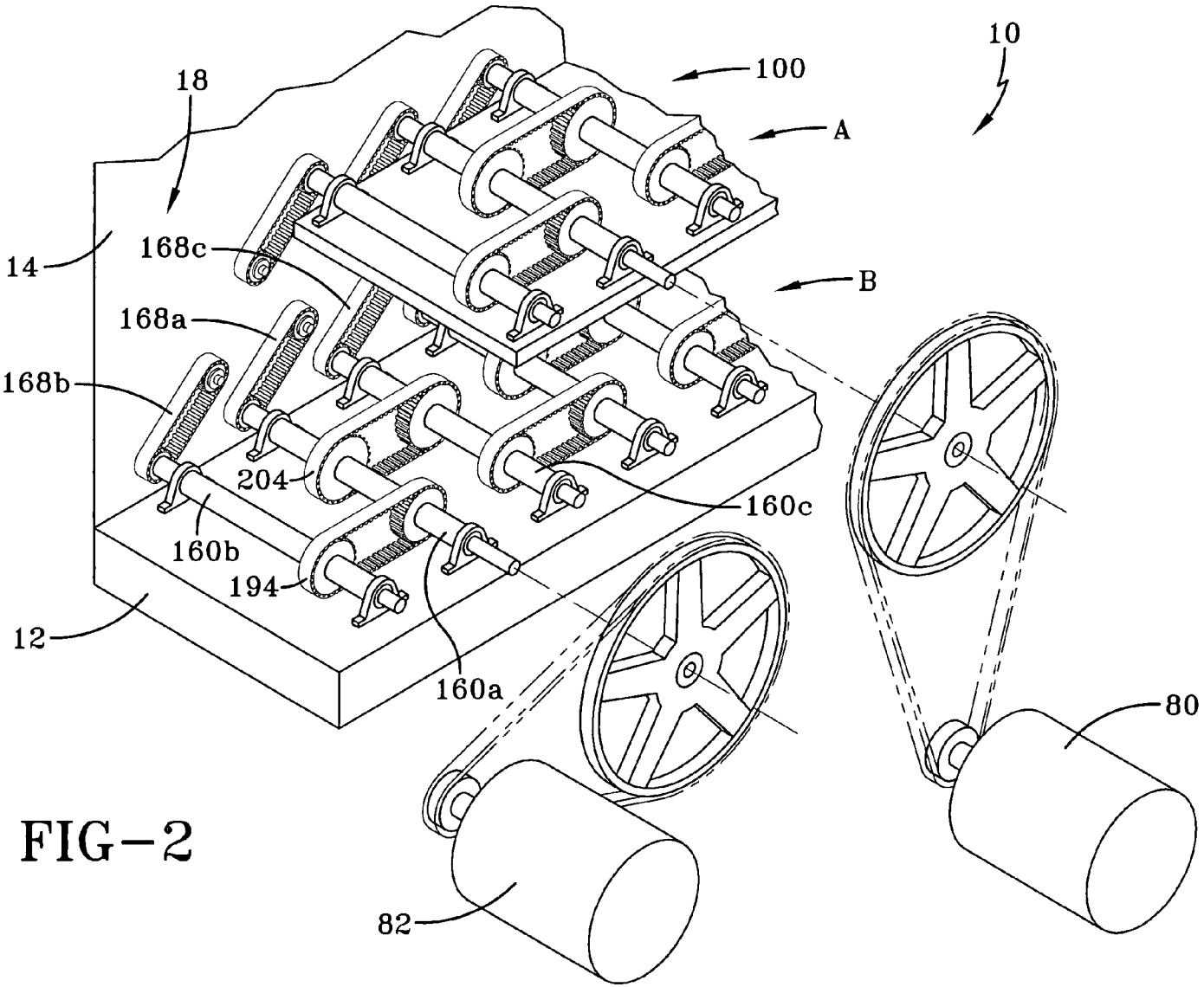
FIG. 2 is a perspective back view of the wire drawing machine of FIG. 1 with a back panel removed to show the drive system used to rotate the drawing blocks and partially in schematic form to show the motors.

Referring now to the drawings wherein the showings are for purposes of illustrating a preferred embodiment of the invention only and not for purposes of limiting the same, FIGS. 1–2 show front and back views of a wire drawing machine 10 according to this invention. While the wire drawing machine shown is intended for the drawing of "fine" wire, typically referred to as a fine wire drawing machine, it should be noted that this invention can have a wide range of applications including other types of wire drawing machines. The particular wire drawn according to this invention can be any type chosen with sound engineering judgment.

With continuing reference to FIGS. 1–2, the wire drawing machine 10 includes a frame 12 and a dividing wall 14 that separates the front 16 (seen in FIG. 1) from the back 18 (seen in FIG. 2). Preferably, one drawing block 70 is used to draw wire through each wire die 50. The various dies 50 and drawing blocks 70 can be seen in FIG. 1 on the front 16 of the wire drawing machine 10. The preferred wire drawing machine 10 includes two banks of dies and blocks 50, 70 where the top bank is labeled A and the bottom bank is labeled B. Reference 50 is used to refer to the dies generally whereas the same reference 50 with an additional letter, such as 50*a*, 50*b*, 50*c*, etc., is used to refer to individual dies. Similarly, the drawing blocks are labeled 70 generally whereas the same reference 70 with an additional letter such as 70*a*, 70*b*, 70*c*, etc., is used to refer to individual drawing blocks. The wire drawing machine 10 shown in the FIGURES is a wet wire drawing machine and thus includes a channel 40 to hold a liquid lubricant that submerges the dies and wire as it moves through the dies 50 and drawing blocks 70. The general operation of the dies 50 and drawing blocks 70 of this invention are conventional and thus will not be described further.

Figure 3:
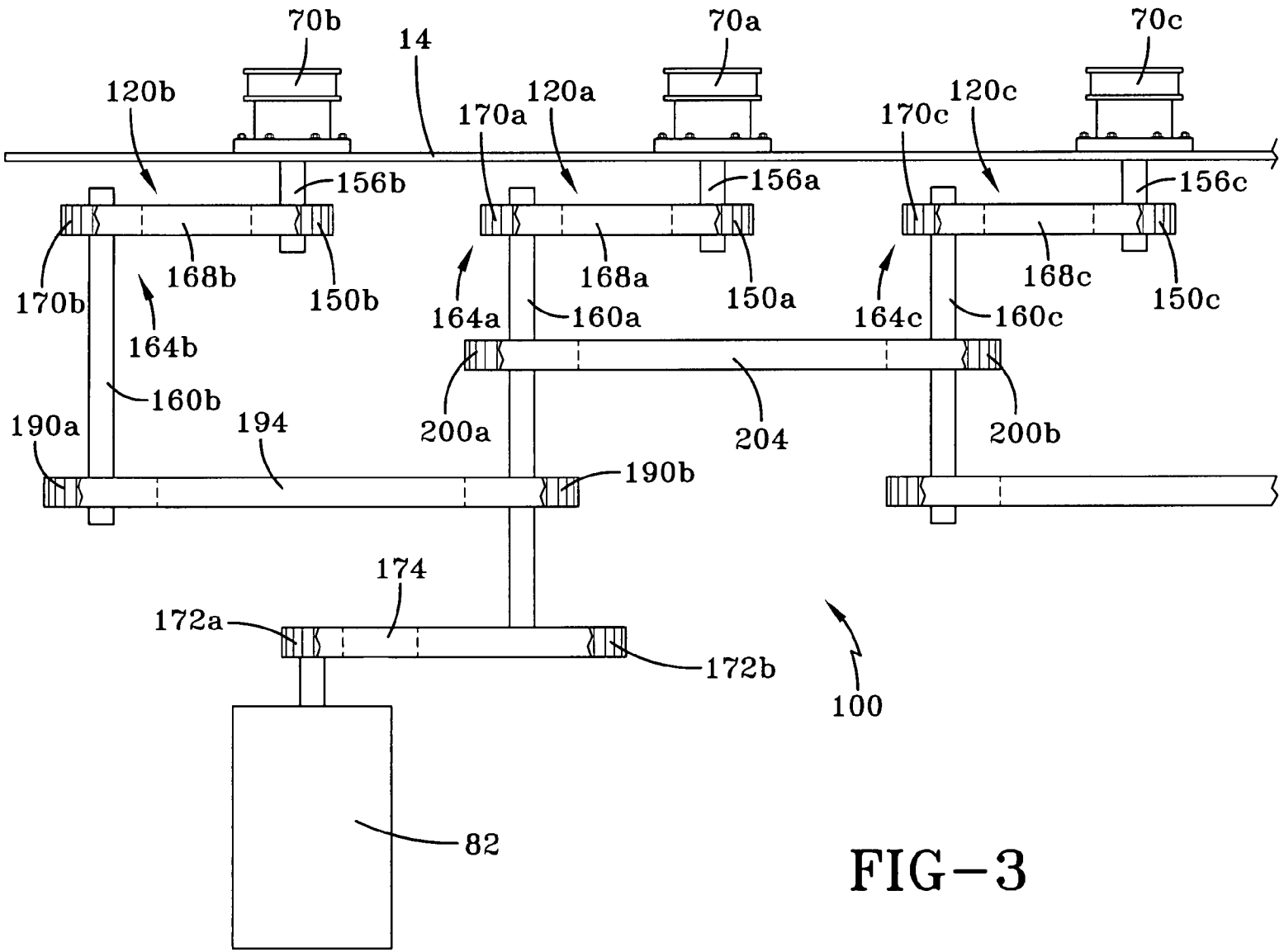
FIG. 3 is a schematic representation illustrating the drive system of this invention.
Figure 4:
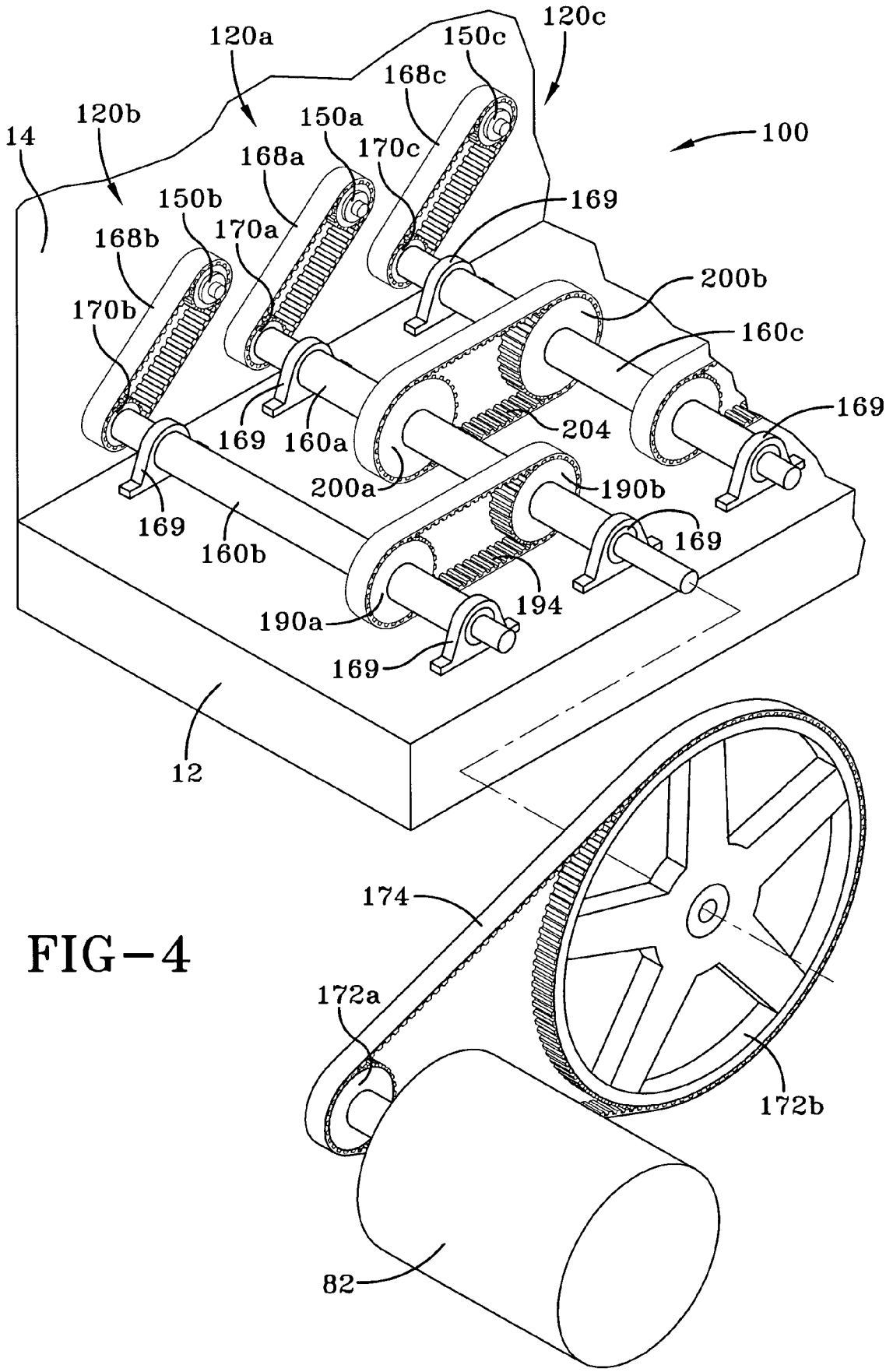
FIG. 4 is a close up view similar to that shown in FIG. 2 showing the drive means used to operatively connect the motor to the drawing blocks.

With reference now to FIGS. 2–4, a drive system 100 used to rotate the drawing blocks 70 so that wire is drawn through the dies 50 will be described. Preferably the drive system 100 includes first and second motors 80, 82 as shown. It should be understood that the number of motors required with this invention can be optimized based on motor performance rather, than the number of drawing blocks 70 and can be one single motor. In the embodiment shown, the first motor 80 is used to provide power to the top bank A of drawing blocks and dies while the second motor 82 is used to provide power to the bottom bank B of drawing blocks and dies. Preferably, the first motor 80 is the "master" motor while the second motor 82 is the "slave" motor. The master motor 80 is used to control the final speed of the wire through the wire drawing machine 10. The slave motor 82 adjusts to the master motor 80 so that the wire is processed through the dies in a manner that will correspond to the desired final wire drawing speed.

With continuing reference to FIGS. 2–4, the drive system 100 also includes drive means 120 that operatively connects the motors 80, 82 to the drawing blocks 70. More specifically, a first drive means 120*a* operatively connects the second motor 82 to the first drawing block 70*a*, a second drive means 120*b* operatively connects the second motor 82 to the second drawing block 70*b*, a third drive means 120*c* operatively connects the second motor 82 to the third drawing block 70*c*, etc. In the preferred embodiment, the total number of individual drive means 120 required corresponds to the total number of drawing blocks 70 being rotated. Thus, for example, if the wire drawing machine 10 has thirty (30) drawing blocks 70, then thirty (30) drive means 120 may be used. The first drive means 120*a* may be selectively adjusted to drive the first drawing block 70*a* at a first rotational condition chosen with sound engineering judgment. By "rotational condition" it is meant a particular speed and torque supplied to the particular drawing block 70. The first drive means 120*a* also can be selectively adjusted to drive the first drawing block 70*a* at any second rotational condition chosen with sound engineering judgment. In fact, any number of rotational conditions are possible for each drawing block as will be described further below. Each adjustment can be made easily and without any need to increase the limited number of motors provided.

Still referring to FIGS. 2–4 but especially FIG. 3, in the preferred embodiment each drive means 120 uses rotational members 150 rotatably connected to shafts as shown and described further below. More specifically, each preferred drive means 120 includes a belt drive system using belts and sprockets (the sprockets serve as the rotational members 150). The preferred belts are timing belts with teeth that engage with corresponding teeth in the sprockets, as shown. In this way the speed of each drawing block 70 can be carefully controlled. It should be noted, however, that this invention would also work well if instead of using belts and sprockets, belts and pulleys were used, or chains and sprockets, or gears that directly intermesh with each other. All that is required is that specific control of each drawing block 70 be provided by the rotational members. Preferably, the first drive means 120*a* includes a first rotational member 150*a* (most preferably a sprocket) that is rotatably attached to a first block shaft 156*a* that is rotatably attached to the first drawing block 70*a*. Thus, rotation of the first rotational member 150*a* causes rotation of the first drawing block 70*a*. The first rotational member 150*a* is rotated by a first drive shaft 160*a* via a first belt system 164*a* that includes first belt 168*a* and first sprocket 170*a*. The first drive shaft 160*a* may be supported for rotation by bearings 169 and is preferably rotated by the second motor 82. The connection between the second motor 82 and the first drive shaft 160*a* may include a pair of motor sprockets 172*a*, 172*b* rotatably connected together with motor belt 174. The motor sprocket 172*b* may be fixedly connected to the first drive shaft 160*a* so that rotation of the motor sprocket 172*b* will cause rotation of the first drive shaft 160*a*. The particular sizes used for the motor sprockets 172*a*, 172*b* and motor belt 174 can be chosen with sound engineering judgment to optimize the size and number of motors required for the entire wire drawing machine 10. This is an improvement over known machines that require a separate motor for each drawing block in order to individually control the rotation of each drawing block.

Figure 5:
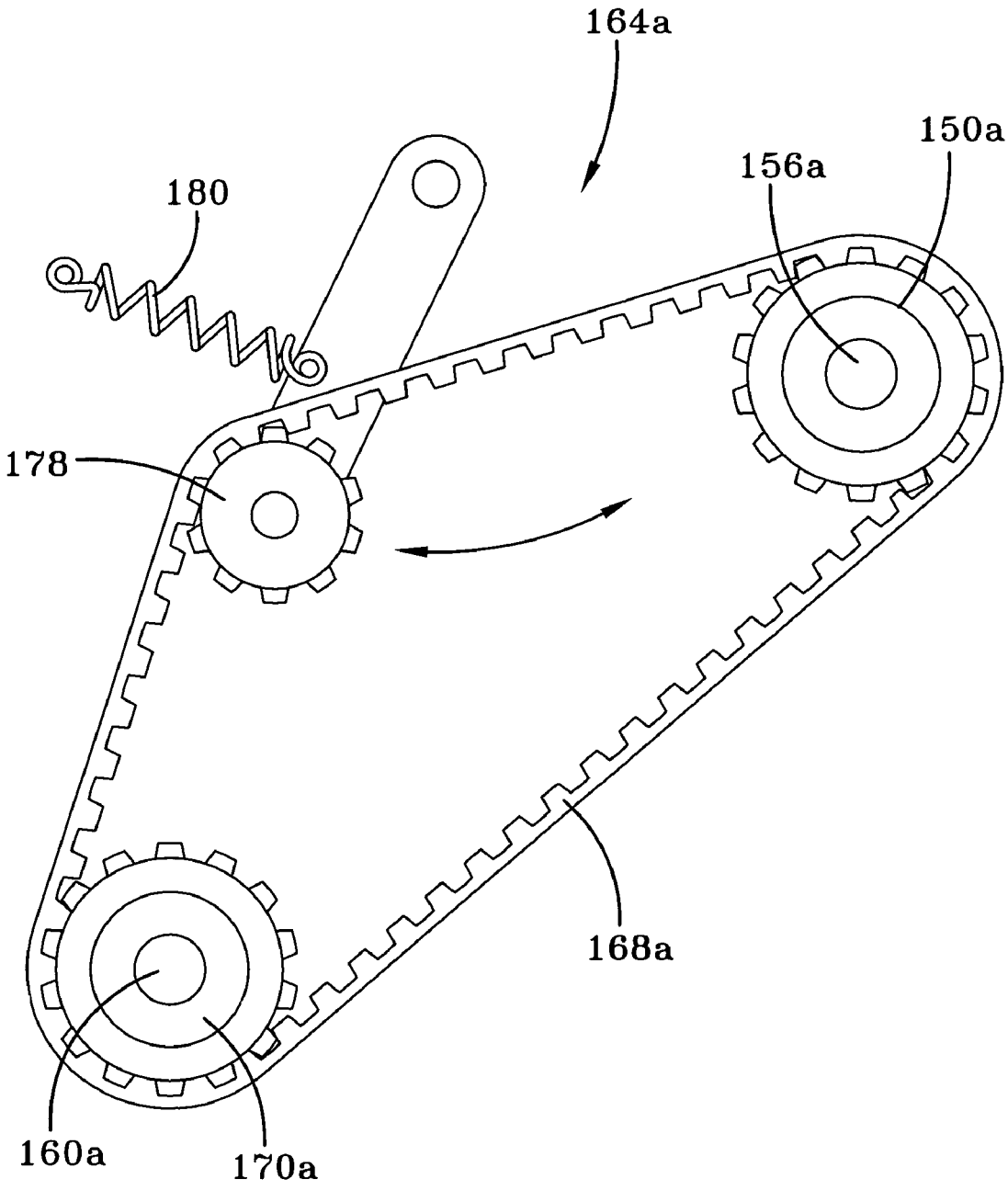
FIG. 5 is a schematic representation illustrating the preferred belt system used with the drive system of this invention.

With reference to FIGS. 3 and 5, the first rotational member 150*a* will provide a first rotational condition, a specific speed and torque, to the first drawing block 70*a*. To change the first rotational condition of the first drawing block 70*a*, it is only necessary to replace the first rotational member 150*a* with a second rotational member. In the preferred embodiment, the second rotational member is a second sprocket having a different diameter and/or a different number of teeth. If the first belt system 164*a* includes only first belt 168*a* and first sprocket 170*a*, as shown in FIGS. 2 and 4, then replacing the first rotational member 150*a* with the second rotational member will also require replacing the first belt 168*a* with a second belt having a different but corresponding length. In a second and preferred embodiment shown in FIG. 5, however, the first belt system 164*a* also includes an idler member 178, such as an idler sprocket. The idler member 178 is preferably biased using biasing means such as a spring 180 in a conventional manner to maintain tension in the first belt system 164*a*. In this case, replacing the first rotational member 150*a* with the second rotational member requires first that the idler member be pivoted to take tension out of the first belt 168*a* so that the first belt 168*a* can be removed from the first rotational member 150*a*. The first rotational member 150*a* is then removed and the second rotational member is attached to the first block shaft 156*a*. The same belt 168*a* can then be used even though the second rotational member may have a different diameter than the first rotational member 150*a*. The biased idler member 178 will take up more or less tension as required.

With reference now to FIGS. 2–5, preferably, the second drive means 120*b* includes a first rotational member 150*b* (most preferably a sprocket) that is rotatably attached to a first block shaft 156*b* that is rotatably attached to the second drawing block 70*b*. Thus, rotation of the first rotational member 150*b* causes rotation of the second drawing block 70*b*. The first rotational member 150*b* is rotated by a first drive shaft 160*b* via a first belt system 164*b* that includes first belt 168*b* and first sprocket 170*b*. The first drive shaft 160*b* is preferably rotated by the second motor 82. The connection between the second motor 82 and the first drive shaft 160*b* preferably includes a pair of drive sprockets 190*a*, 190*b* rotatably connected together with drive belt 194. The drive sprocket 190*b* may be fixedly connected to the first drive shaft 160*a* so that rotation of the motor sprocket 172*b* will cause rotation of the first drive shaft 160*a* and first drive shaft 160*b*. The particular sizes used for the drive sprockets 190*a*, 190*b* and drive belt 194 can be chosen with sound engineering judgment.

With continuing reference to FIGS. 2–5, preferably, the third drive means 120*c* includes a first rotational member 150*c* (most preferably a sprocket) that is rotatably attached to a first block shaft 156*c* that is rotatably attached to the third drawing block 70*c*. Thus, rotation of the first rotational member 150*c* causes rotation of the third drawing block 70*c*. The first rotational member 150*c* is rotated by a first drive shaft 160*c* via a first belt system 164*c* that includes first belt 168*c* and first sprocket 170*c*. The first drive shaft 160*c* is preferably rotated by the second motor 82. The connection between the second motor 82 and the first drive shaft 160*c* preferably includes a pair of drive sprockets 200*a*, 200*b* rotatably connected together with drive belt 204. The drive sprocket 200*b* may be fixedly connected to the first drive shaft 160*c* so that rotation of the motor sprocket 172*b* will cause rotation of the first drive shaft 160*a* and first drive shaft 160*c*. The particular sizes used for the drive sprockets 200*a*, 200*b* and drive belt 204 can be chosen with sound engineering judgment. It should be understood that the same system of belts and sprockets can be used with multiple drawing blocks so that a single motor can provide power for each drawing block. Nonetheless, because each first rotational member can be replaced, ultimate control of each drawing block can be achieved.

We claim:

1. A wire drawing machine comprising:

a frame;

first and second dies operatively supported by the frame;

a first drawing block rotatably supported by the frame for use in drawing wire through the first die;

a second drawing block rotatably supported by the frame for use in drawing the wire through the second die;

a first motor for use in providing power to rotate the first and second drawing blocks;

first drive means connected to the first motor for selectively driving the first drawing block at a first rotational condition, the first drive means comprises a first block shaft that is rotatably attached to the first drawing block;

second drive means connected to the first motor for selectively driving the second drawing block at a first rotational condition, the second drive means comprises a second block shaft that is rotatably attached to the second drawing block;

a first drive shaft that rotates the first block shaft with a first belt and rotates the second block shaft with a second belt;

a second drive shaft that is rotated by the second belt and that rotates the second block shaft with a third belt;

wherein the first drive means can be selectively adjusted to drive the first drawing block at a second rotational condition independent of the rotational condition of the second drawing block; and, wherein the second drive means can be selectively adjusted to drive the second drawing block at a second rotational condition independent of the rotational condition of the first drawing block.

2. The wire drawing machine of claim 1 further comprising:

a third die operatively supported by the frame;

a third drawing block rotatably supported by the frame for use in drawing wire through the third die;

wherein the first motor provides power to rotate the third drawing block;

third drive means connected to the first motor for selectively driving the third drawing block at a first rotational condition;

wherein the third drive means can be selectively adjusted to drive the third drawing block at a second rotational condition independent of the rotational condition of the first and second drawing blocks;

wherein the first drive means can be selectively adjusted to drive the first drawing block at a second rotational condition independent of the rotational condition of the third drawing block; and, wherein the second drive means can be selectively adjusted to drive the second drawing block at a second rotational condition independent of the rotational condition of the third drawing block.

3. A wire drawing machine comprising:

a frame;

first, second, third and fourth dies operatively supported by the frame;

a first drawing block rotatably supported by the frame for use in drawing wire through the first die;

a second drawing block rotatably supported by the frame for use in drawing the wire through the second die;

a third drawing block rotatably supported by the frame for use in drawing the wire through the third die;

a fourth drawing block rotatably supported by the frame for use in drawing the wire through the fourth die;

a first motor for use in providing power to rotate the first and second drawing blocks;

a second motor for use in providing power to rotate the third and fourth drawing blocks;

first drive means connected to the first motor for selectively driving the first drawing block at a first rotational condition;

second drive means connected to the first motor for selectively driving the second drawing block at a first rotational condition;

third drive means connected to the second motor for selectively driving the third drawing block at a first rotational condition;

fourth drive means connected to the second motor for selectively driving the fourth drawing block at a first rotational condition;

wherein the first drive means can be selectively adjusted to drive the first drawing block at a second rotational condition independent of the rotational condition of the second drawing block;

wherein the second drive means can be selectively adjusted to drive the second drawing block at a second rotational condition independent of the rotational condition of the first drawing block;

wherein the third drive means can be selectively adjusted to drive the third drawing block at a second rotational condition independent of the rotational condition of the fourth drawing block; and, wherein the fourth drive means can be selectively adjusted to drive the fourth drawing block at a second rotational condition independent of the rotational condition of the third drawing block.

4. The wire drawing machine of claim 3 wherein the first motor is a master motor and the second motor is a slave motor to the first motor.

5. A wire drawing machine comprising:

a frame;

first and second dies operatively supported by the frame;

a first drawing block rotatably supported by the frame for use in drawing wire through the first die;

a second drawing block rotatably supported by the frame for use in drawing the wire through the second die;

a first motor for use in providing power to rotate the first and second drawing blocks;

first drive means connected to the first motor for selectively driving the first drawing block at a first rotational condition, the first drive means comprising:

(a) a first rotational member for the first drive means used to provide the first rotational condition;

(b) a second rotational member for the first drive means that selectively replaces the first rotational member for the first drive means and provides the second rotational condition; and, (c) wherein the first and second rotational members for the first drive means are sprockets of differing size;

second drive means connected to the first motor for selectively driving the second drawing block at a first rotational condition, the second drive means comprising:

(a) a first rotational member for the second drive means used to provide the first rotational condition;

(b) a second rotational member for the second drive means that selectively replaces the first rotational member for the second drive means and provides the second rotational condition;

(c) wherein the first and second rotational members for the second drive means are sprockets of differing size;

wherein the first drive means can be selectively adjusted to drive the first drawing block at a second rotational condition independent of the rotational condition of the second drawing block; and, wherein the second drive means can be selectively adjusted to drive the second drawing block at a second rotational condition independent of the rotational condition of the first drawing block.

6. The wire drawing machine of claim 5 wherein:

the first drive means further comprises:

an idler member; and, a belt member received by the idler member, the belt member selectively used to rotate the first rotational member for the first drive means and selectively used to rotate the second rotational member for the first drive means.

* * * * *